US009834990B2

(12) United States Patent
Bowley et al.

(10) Patent No.: US 9,834,990 B2
(45) Date of Patent: Dec. 5, 2017

(54) BOGEY STYLE TORQUE BUSHING FOR TOP DRIVE

(71) Applicant: TESCO CORPORATION, Houston, TX (US)

(72) Inventors: Ryan Thomas Bowley, Calgary (CA); Edgar Fernando Yajure, Calgary (CA)

(73) Assignee: TESCO CORPORATION, Houston, TX (US)

( * ) Notice: Subject to any disclaimer, the term of this patent is extended or adjusted under 35 U.S.C. 154(b) by 874 days.

(21) Appl. No.: 14/138,658

(22) Filed: Dec. 23, 2013

(65) Prior Publication Data

US 2014/0182868 A1 Jul. 3, 2014

Related U.S. Application Data

(60) Provisional application No. 61/746,873, filed on Dec. 28, 2012.

(51) Int. Cl.

| | |
|---|---|
| ***E21B 3/02*** | (2006.01) |
| ***E21B 15/00*** | (2006.01) |
| ***E21B 19/02*** | (2006.01) |

(52) U.S. Cl.

CPC ..... *E21B 3/02* (2013.01); *E21B 15/00* (2013.01); *E21B 19/02* (2013.01)

(58) Field of Classification Search

CPC . E21B 15/00; E21B 3/02; E21B 41/00; E21B 12/00

USPC ..... 173/184

See application file for complete search history.

(56) References Cited

U.S. PATENT DOCUMENTS

| | | | | |
|---|---|---|---|---|
| 4,449,596 | A | 5/1984 | Boyadjieff | |
| 5,251,709 | A | 10/1993 | Richardson | |
| 7,100,709 | B2 * | 9/2006 | Bowe | E21B 7/021 173/192 |
| 7,380,611 | B2 * | 6/2008 | Ostling | B28D 1/14 173/147 |
| 2007/0137874 | A1 * | 6/2007 | Ostling | B28D 1/14 173/184 |
| 2011/0203820 | A1 * | 8/2011 | Marica | B61B 15/00 173/1 |
| 2012/0181083 | A1 | 7/2012 | Fallen | |

OTHER PUBLICATIONS

International Search Report & Written Opinion for International Application No. PCT/US2013/077650 dated Nov. 5, 2014.

* cited by examiner

*Primary Examiner* — Michelle Lopez
(74) *Attorney, Agent, or Firm* — Fletcher Yoder, P.C.

(57) ABSTRACT

Present embodiments are directed to a top drive system having a top drive, a bogey chassis, wherein the top drive is coupled with the bogey chassis, an upper bushing coupling the bogey chassis to a torque track, and a lower bushing coupling the bogey chassis to the torque track, wherein the upper and lower bushings are configured to translate along the torque track.

21 Claims, 11 Drawing Sheets

BOGEY STYLE TORQUE BUSHING FOR TOP DRIVE

CROSS-REFERENCE TO RELATED APPLICATIONS

This application claims priority from and the benefit of U.S. Provisional Application Ser. No. 61/746,873, entitled "Bogey Style Torque Bushing for Top Drive," filed Dec. 28, 2012, which is hereby incorporated by reference in its entirety.

BACKGROUND

Embodiments of the present disclosure relate generally to the field of drilling and processing of wells. More particularly, present embodiments relate to a system and method for stabilizing a top drive during a drilling process, a casing process, or another type of well processing operation.

Top drives are typically utilized in well drilling and maintenance operations, such as operations related to oil and gas exploration. In conventional oil and gas operations, a well is typically drilled to a desired depth with a drill string, which includes drill pipe and a drilling bottom hole assembly (BHA). During a drilling process, the drill string may be supported and hoisted about a drilling rig by a hoisting system for eventual positioning down hole in a well. As the drill string is lowered into the well, a top drive system may rotate the drill string to facilitate drilling.

BRIEF DESCRIPTION

In accordance with one aspect of the disclosure, a top drive system includes a top drive, a bogey chassis, wherein the top drive is coupled with the bogey chassis, an upper bushing coupling the bogey chassis to a torque track, and a lower bushing coupling the bogey chassis to the torque track, wherein the upper and lower bushings are configured to translate along the torque track.

Another embodiment includes a system having a top drive, a torque bushing system coupled to the top drive comprising a first bushing and a second bushing, and a torque track system, wherein the torque bushing system is configured to absorb an overturning moment acting on the top drive and apply resultant linear forces to the torque track system.

In accordance with another aspect of the disclosure, a method includes suspending a top drive system with a hoist and a torque bushing system, applying an overturning moment to the top drive system, and applying resultant linear forces to a torque track system using first and second bushings of the torque bushing system to counterbalance the overturning moment.

DRAWINGS

These and other features, aspects, and advantages of present embodiments will become better understood when the following detailed description is read with reference to the accompanying drawings in which like characters represent like parts throughout the drawings, wherein.

DETAILED DESCRIPTION

Torque bushings, along with a torque track, may be primarily designed to react to torsional forces along a vertical axis coming from a drilling rotation of a drill string. It is now recognized that top drive systems may have a center of gravity that is offset from a lifting axis or hanging load of the top drive system. Specifically, it is now recognized that the offset center of gravity may cause an overturning moment acting on the top drive system (e.g., around a horizontal axis), which may result in excessive or premature wear on top drive system components or other components coupled to the top drive system. Accordingly, there is a presently recognized need to absorb and/or account for overturning moments acting on a top drive system and related components.

Present embodiments provide a bogey style torque bushing system for a top drive system. Specifically, the bogey style torque bushing system is configured to absorb overturning moment reaction forces caused by the offset center of gravity of a top drive with respect to its lifting point and drill string axis. For example, the bogey style torque bushing system may couple the top drive to a torque track system of a derrick or other surface equipment. In certain embodiments, a top drive may be coupled to a bogey chassis of the bogey style torque bushing system, and the bogey chassis may be coupled to a torque track system by two or more bushings. As discussed in detail below, overturning moment reaction forces created by the top drive may act on respective centers of the bushings, which may be configured to transfer distributed direct normal forces (resulting from the overturning moment reaction forces) to the torque track system. In this manner, resultant forces caused by the overturning moment and acting on other components of the top drive system may be absorbed and distributed evenly throughout the torque bushing surface, while reducing premature and excessive wear on torque bushing components.

Thus, present embodiments improve top drive performance and prolong the useful life of a top drive.

Figure 1:
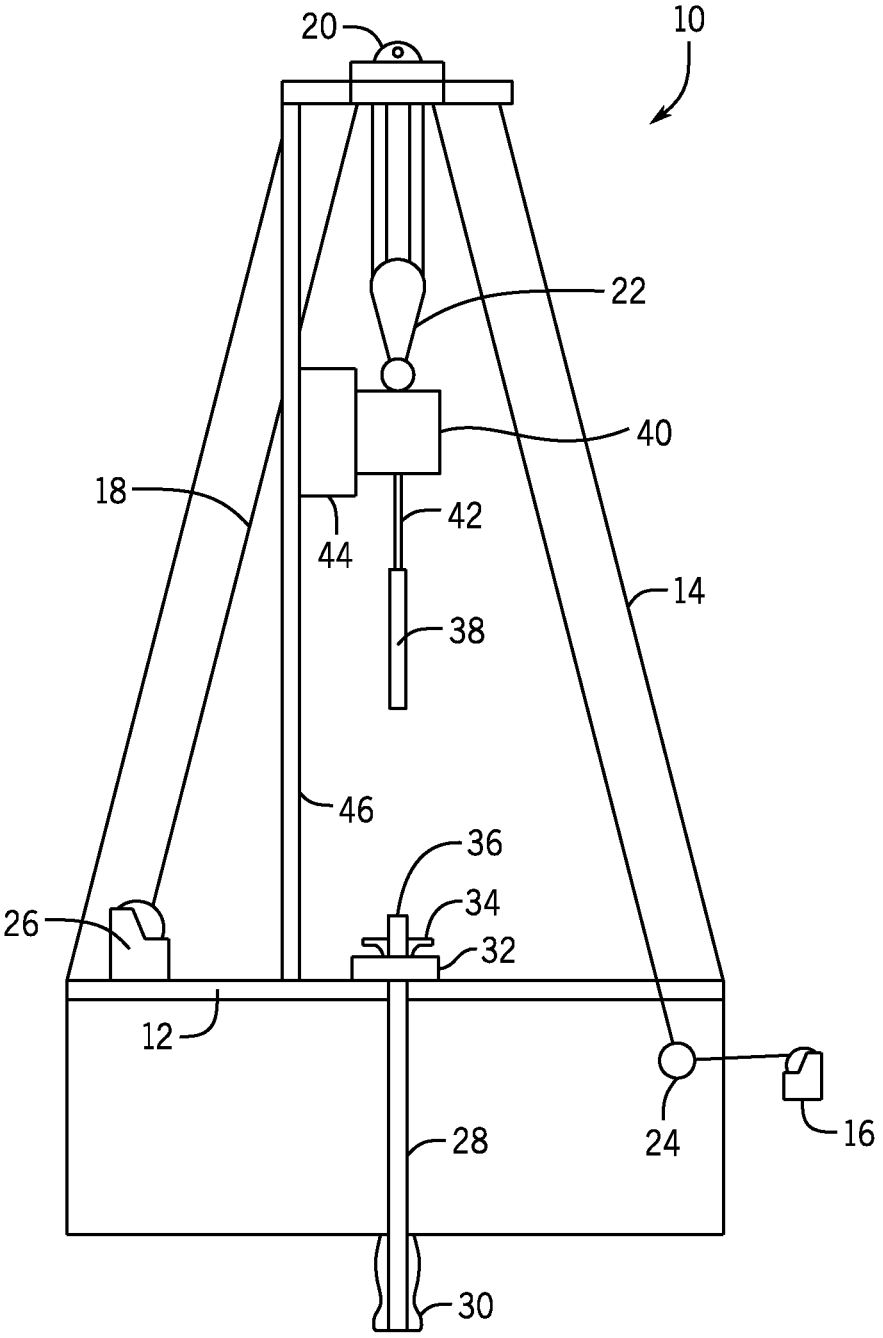
FIG. 1 is a schematic of a well being drilled, in accordance with present techniques.

Turning now to the drawings, FIG. 1 is a schematic of a drilling rig 10 in the process of drilling a well in accordance with present techniques. The drilling rig 10 features an elevated rig floor 12 and a derrick 14 extending above the rig floor 12. A supply reel 16 supplies drilling line 18 to a crown block 20 and traveling block 22 configured to hoist various types of drilling equipment above the rig floor 12. The drilling line 18 is secured to a deadline tiedown anchor 24, and a drawworks 26 regulates the amount of drilling line 18 in use and, consequently, the height of the traveling block 22 at a given moment. Below the rig floor 12, a drill string 28 extends downward into a wellbore 30 and is held stationary with respect to the rig floor 12 by a rotary table 32 and slips 34. A portion of the drill string 28 extends above the rig floor 12, forming a stump 36 to which another length of tubular 38 may be added. A top drive 40, hoisted by the traveling block 22, positions the tubular 38 above the wellbore before coupling with the tubular 38. The top drive 40, once coupled with the tubular 38, may then lower the coupled tubular 38 toward the stump 36 and rotate the tubular 38 such that it connects with the stump 36 and becomes part of the drill string 28. Specifically, the top drive 40 includes a quill 42 used to turn the tubular 38 or other drilling equipment.

FIG. 1 further illustrates the top drive 40 coupled to a bogey style torque bushing system 44. More specifically, the bogey style torque bushing system 44 couples the top drive 40 to a torque track 46. As discussed below, the center of gravity of the top drive 40 may not be centered above the quill 42 and/or tubular 38 (e.g., a hanging load of the top drive 40). Consequently, the top drive 40 may experience a moment or rotating force (e.g., an overturning moment), which is counterbalanced (e.g., counter reacted) by other features. For example, the torque track 46 of the top drive 40 may function to counterbalance (e.g., counter react) the moment. In other words, the torque track 46 (e.g., a torque bushing coupled to the torque track) may experience forces that counteract the overturning moment created by the unbalanced center of gravity of the top drive 40. As a result, when this occurs on traditional systems, components of the torque track 46 (e.g., a torque bushing) may experience corresponding substantial wear. As discussed in detail below, in accordance with present embodiments, the bogey style torque bushing system 44 of the top drive 40 is configured to counteract the overturning moment created by the unbalanced center of gravity of the top drive 40 and direct distributed normal forces to the torque track 46. In this manner, wear on the torque track 46 and other components of the top drive 40 caused by the overturning moment may be reduced.

It should be noted that the illustration of FIG. 1 is intentionally simplified to focus on the top drive 40 with the bogey style torque bushing system 44 described in detail below. Many other components and tools may be employed during the various periods of formation and preparation of the well. Similarly, as will be appreciated by those skilled in the art, the orientation and environment of the well may vary widely depending upon the location and situation of the formations of interest. For example, rather than a generally vertical bore, the well, in practice, may include one or more deviations, including angled and horizontal runs. Similarly, while shown as a surface (land-based) operation, the well may be formed in water of various depths, in which case the topside equipment may include an anchored or floating platform.

Figure 2:
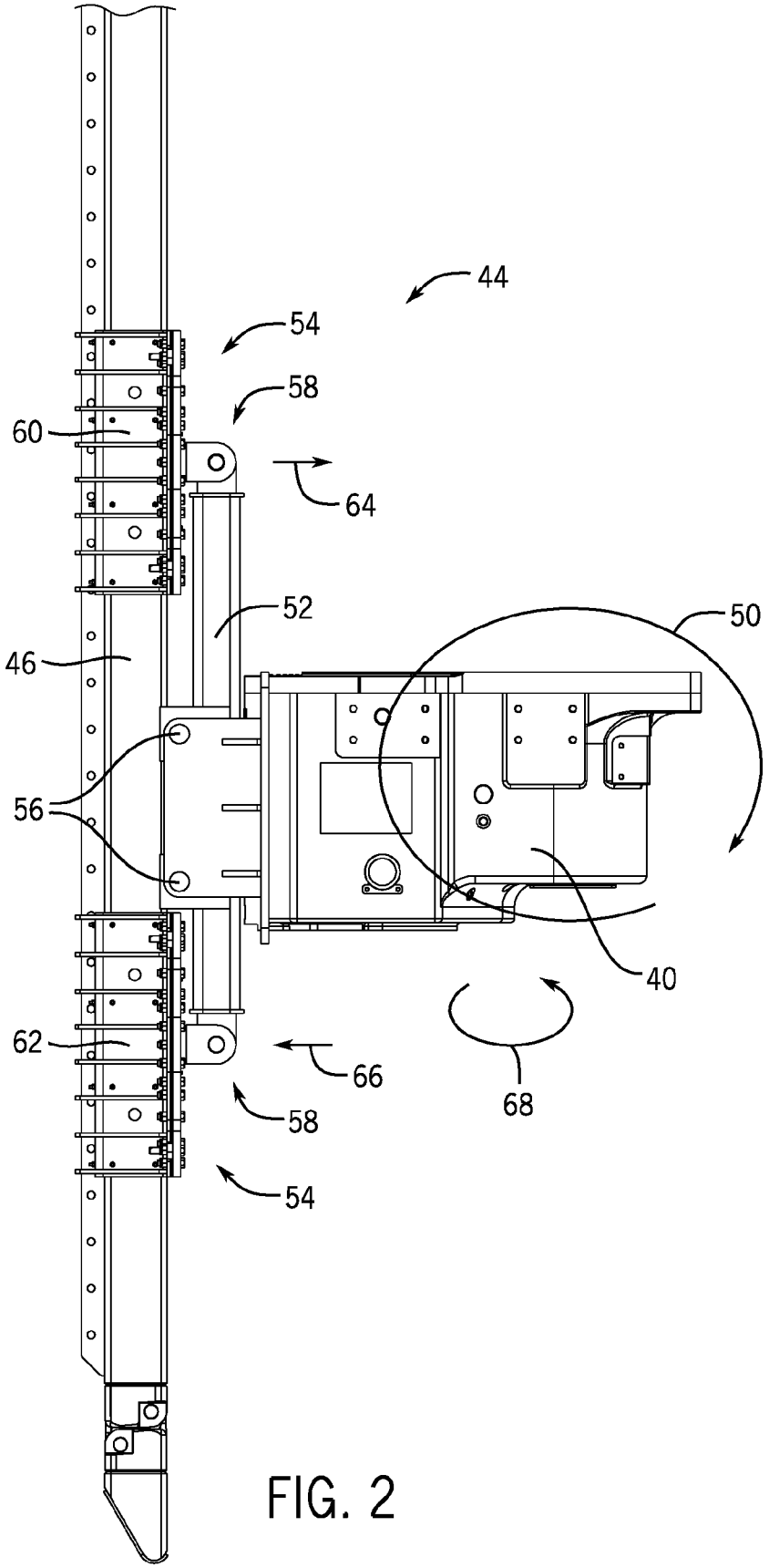
FIG. 2 is a side view of a top drive having a bogey style torque bushing system, in accordance with present techniques.

FIG. 2 is a side view of an embodiment of the top drive 40 coupled to the torque track 46 with the bogey style torque bushing system 44. As mentioned above, the top drive 40 may experience an overturning moment 50, such as when the quill 42 and/or tubular 38 supported by the top drive 40 is not in line with the center of gravity of the top drive 40. That is, the overturning moment 50 is caused by the top drive 40 center of gravity being offset from the lifting or hanging load axis. In order to absorb and counteract the overturning moment 50 experienced by the top drive 40, the illustrated embodiment includes the bogey style torque bushing system 44.

Specifically, the bogey style torque bushing system 44 includes a bogey chassis 52, which is coupled to the top drive 40 and to the torque track 46 with bushings 54 (e.g., upper bushing 60 and lower bushing 62). In particular, the illustrated embodiment includes two bushings 54. However, in other embodiments, additional bushings 54 may be used. As described in detail below, the use of two or more bushings 54 enables the absorption of the moments acting on the torque track 46, as well as the distribution of resultant linear forces acting on the torque track 46 that are created by the overturning moment 50. As shown, pinned connections 56 are used to couple the top drive 40 to the bogey chassis 52. The pinned connections 56 secure the top drive 40 such that the top drive 40 does not move or translate along the bogey chassis 52. In other words, the top drive 40 is fixed to the bogey chassis 52. However, in other embodiments, the pinned (e.g., fixed) location of the top drive 40 along the length of the bogey chassis 52 may vary relative to the fixed position of the top drive 40 in the illustrated embodiment. As discussed below, the location of the top drive 40 along the bogey chassis 52 may partially determine the magnitude of the various forces acting on the bushings 54 of the bogey style torque bushing system 44.

Furthermore, pinned connections 58 are used to couple the top drive 40 to the bushings 54. In this manner, the bogey chassis 52 may absorb bending moments (e.g., moments with a horizontal axis) from the top drive 40. However, bending moments may not be transferred through the bushings 54 individually due to the pinned connections 58 coupling the bogey chassis 52 to the bushings 54. Instead, the overturning moment 50 will produce substantially evenly distributed resultant linear forces on each of the bushings 54. For example, the overturning moment 50 in the illustrated embodiment will produce a liner force 64 in the upper bushing 60 and a linear force 66 in the lower bushing 62.

As mentioned above, the pinned location of the top drive 40 along the bogey chassis 52 may affect the magnitude of various forces acting on the bushings 54. For example, a torsion 68 acting on the top drive 40 (e.g., a drilling torque) may be transferred to the bushings 54. That is, while the pinned connections 58 coupling the bogey chassis 52 to the bushings 54 may block transfer a moment with a horizontal axis (e.g., overturning moment 50), the pinned connections 58 may still transfer a moment with a vertical axis (e.g., torsion 68) to the bushings 54. However, the location of the top drive 40 along the bogey chassis 52 may be selected to selectively distribute the forces caused by the torsion 68. For example, in the illustrated embodiment, the top drive 40 is positioned along the bogey chassis 52 closer to the bottom bushing 62 than the top bushing 60. As such, the bottom bushing 62 may experience greater forces (e.g., bending moments) resulting from the torsion 68 than the top bushing 60.

The bushings 54 may have a variety of configurations. While each bushing 54 is configured to couple the bogey chassis 52 to the torque track 46, each bushing 54 may also be configured to translate along the torque track 46. For example, each bushing 54 may include low friction mechanisms, such as rollers or wheels, to enable the bushing 54 to slide or translate along the torque track 46. As a result, the top drive 40 may be moved vertically to enable the positioning or landing of the tubular 38 or other equipment. Additionally, as described in detail below, the bogey style torque bushing system 44 may include features to enable to horizontal displacement of the top drive 40.

Figure 3:
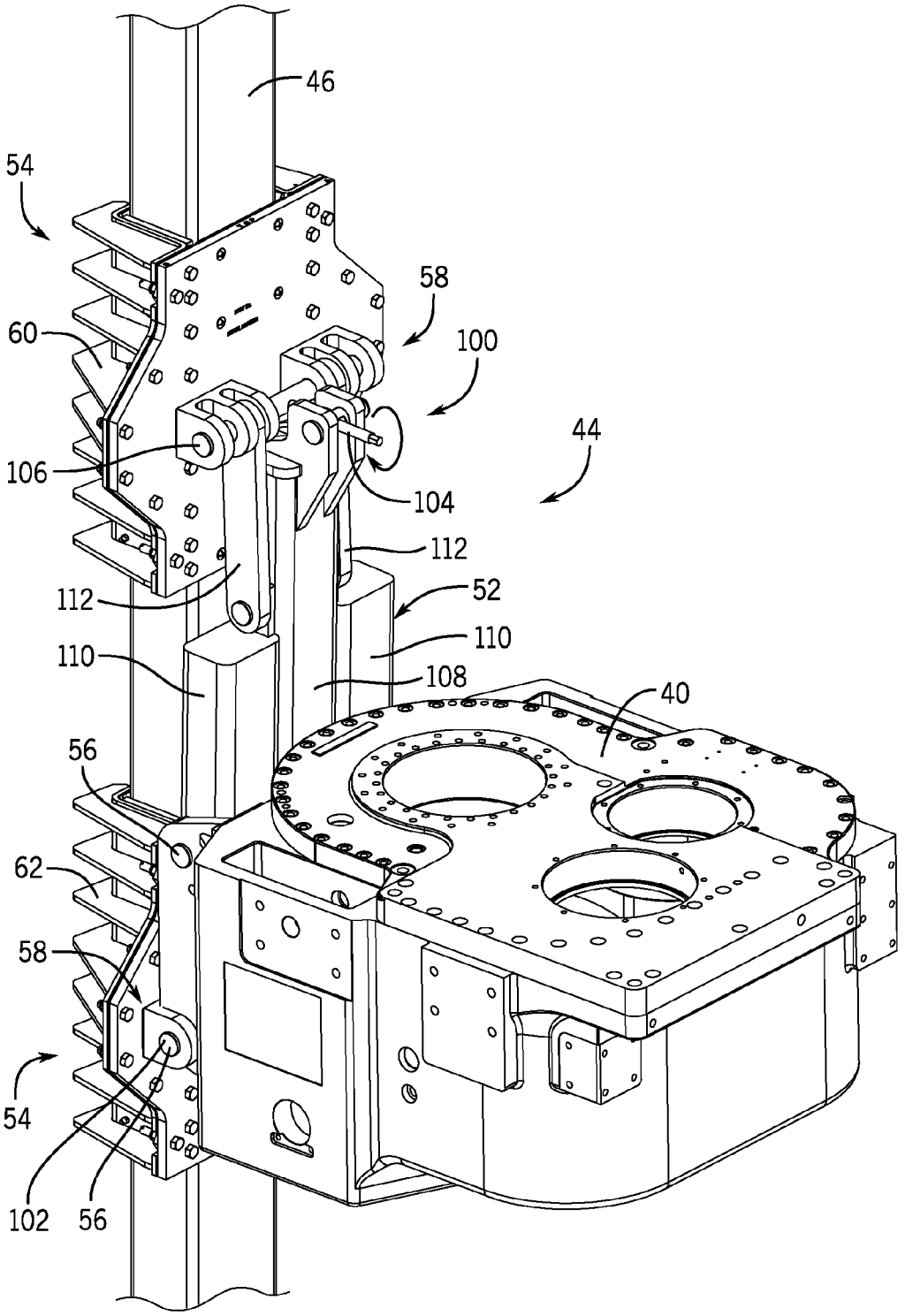
FIG. 3 is a perspective view of a top drive having a bogey style torque bushing system, in accordance with present technique.

FIG. 3 is a perspective view of an embodiment of the top drive 40 having the bogey style torque bushing system 44. The illustrated embodiment includes similar elements and element numbers as the embodiment shown in FIG. 3. Additionally, the illustrated embodiment of the bogey style torque bushing system 44 includes a leveling system 100.

As described above, the top drive 40 is coupled to the bogey chassis 52 by pinned connections 56, and the bogey chassis 52 is coupled to the bushings 54 by pinned connections 58. In the illustrated embodiment, the top drive 40, the bogey chassis 52, and the lower bushing 62 are all coupled by a single pinned connection 102. That is, the lower pinned connection 56 and pinned connection 58 for the lower bushing 62 are the same single pinned connection 102. As a result, the top drive 40 is positioned much closer to the lower bushing 62 than the upper bushing 60. As such, a drilling torque or other torsion (e.g., torsion 68 of FIG. 2) acting on the top drive 40 may produce resultant forces (e.g., moments) acting on the lower bushing 62 that are greater than resultant forces (e.g., moments) acting on the upper bushing 60 that are produced by a drilling torque or torsion.

Furthermore, the pinned connection 58 coupling the upper bushing 60 to the bogey chassis 52 includes the leveling system 100. More specifically, the leveling system 100 includes an adjustable pin 104 that axially abuts a pin 106 of the pinned connection 58 coupling the upper bushing 50 and the bogey chassis 52. In operation, the adjustable pin 104 may be adjusted to alter the orientation of central member 108 of the bogey chassis 52. For example, the top drive 40 may be fixed (e.g., via pinned connections 56) to the central member 108 and outer members 110 of the bogey chassis 52. As such, the outer members 110 are also fixed to the central member 108 of the bogey chassis 52. Additionally, the central member 108 is coupled to the pinned connection 58 by pivoting members 112. As the adjustable pin 104 is adjusted (e.g., via a threaded connection), the central member 108 of the bogey chassis 52 may pivot about the single pinned connection 102, and the pivoting members 112 may accommodate the adjustment in the orientation of the central member 108. In this manner, the levelness of the top drive 40 may be adjusted.

Figure 5:
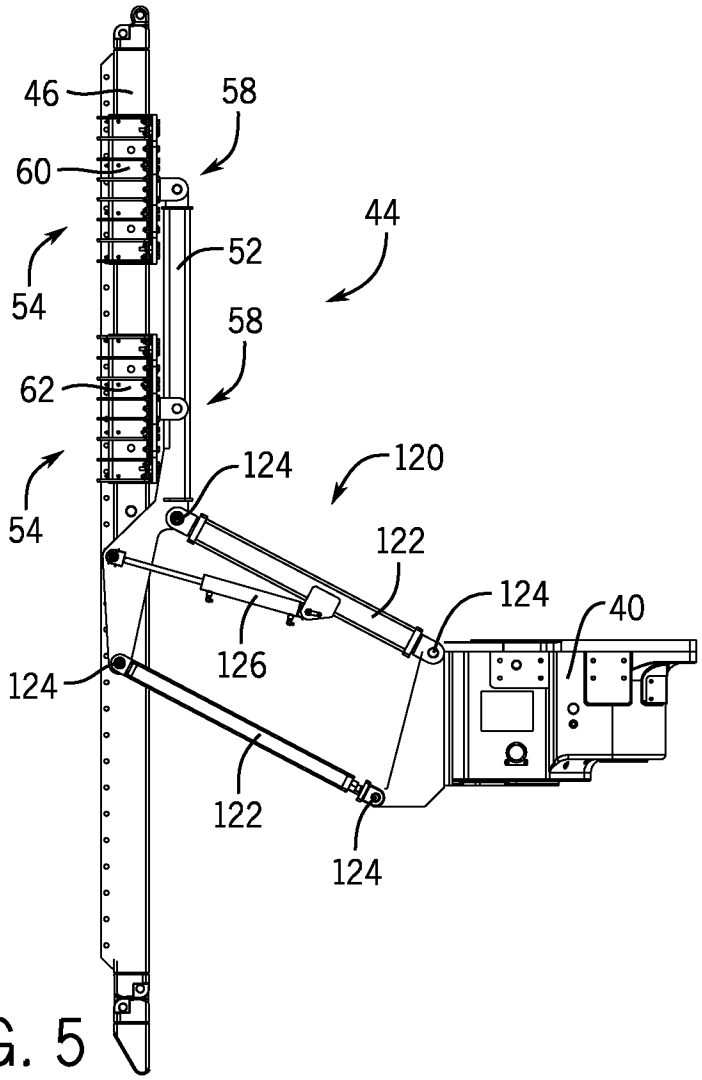
FIG. 5 is a side view of a top drive having a bogey style torque bushing system with a lateral extension mechanism in an extended orientation, in accordance with present techniques.
Figure 4:
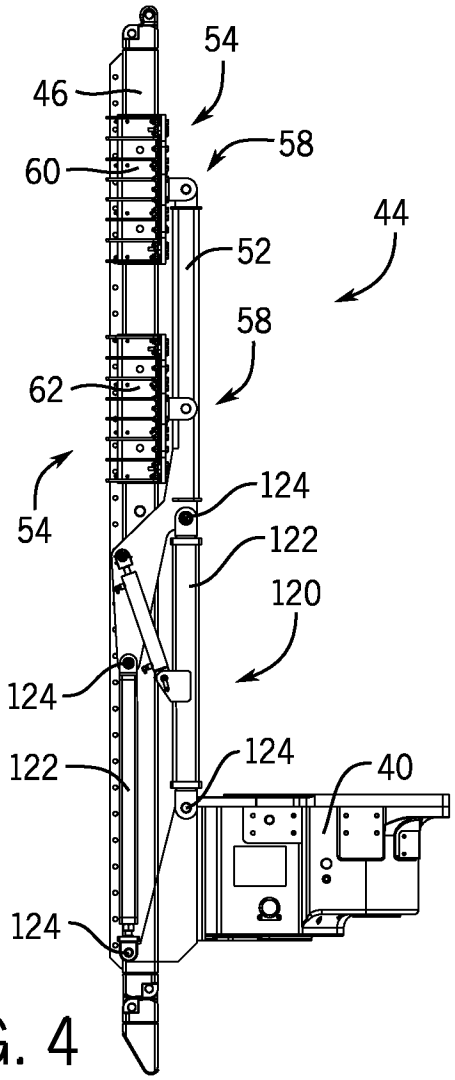
FIG. 4 is a side view of a top drive having a bogey style torque bushing system with a lateral extension mechanism in a retracted orientation, in accordance with present techniques.

FIGS. 4 and 5 are side views of an embodiment of the top drive 40 having the bogey style torque bushing system 44. The illustrated embodiments include similar elements and element numbers as the embodiment illustrated in FIG. 2. Additionally, the bogey style torque bushing system 44 of FIGS. 4 and 5 includes a lateral extension mechanism 120. FIG. 4 shows the lateral extension mechanism 120 in a retracted position, and FIG. 5 shows the lateral extension mechanism 120 in an extended position.

As shown, the lateral extension mechanism 120 extends from the bogey chassis 52. Specifically, the lateral extension mechanism 120 includes pivoting arms 122, which extend from the bogey chassis 52 and couple to the top drive 40. For example, the lateral extension mechanism 120, may include 2, 4, 6, 8, or more pivoting arms 122 that couple the top drive 40 to the bogey chassis 52. As similarly described above, pinned connections 124 are used to couple the pivoting arms 122 to the top drive 40 and the bogey chassis 52.

In the retracted position shown in FIG. 4, the pivoting arms 122 are substantially parallel with the torque track 46, thereby positioning the top drive 40 adjacent to the torque track 46. In the extended position shown in FIG. 5, the pivoting arms 122 of the lateral extension mechanism 120 swing out from the torque track 46, thereby increasing the lateral distance between the top drive 40 and the torque track 46. For example, the pivoting arms 122 may be pivoted outwardly using one or more hydraulic cylinders 126 or other actuation mechanisms.

Figure 6:
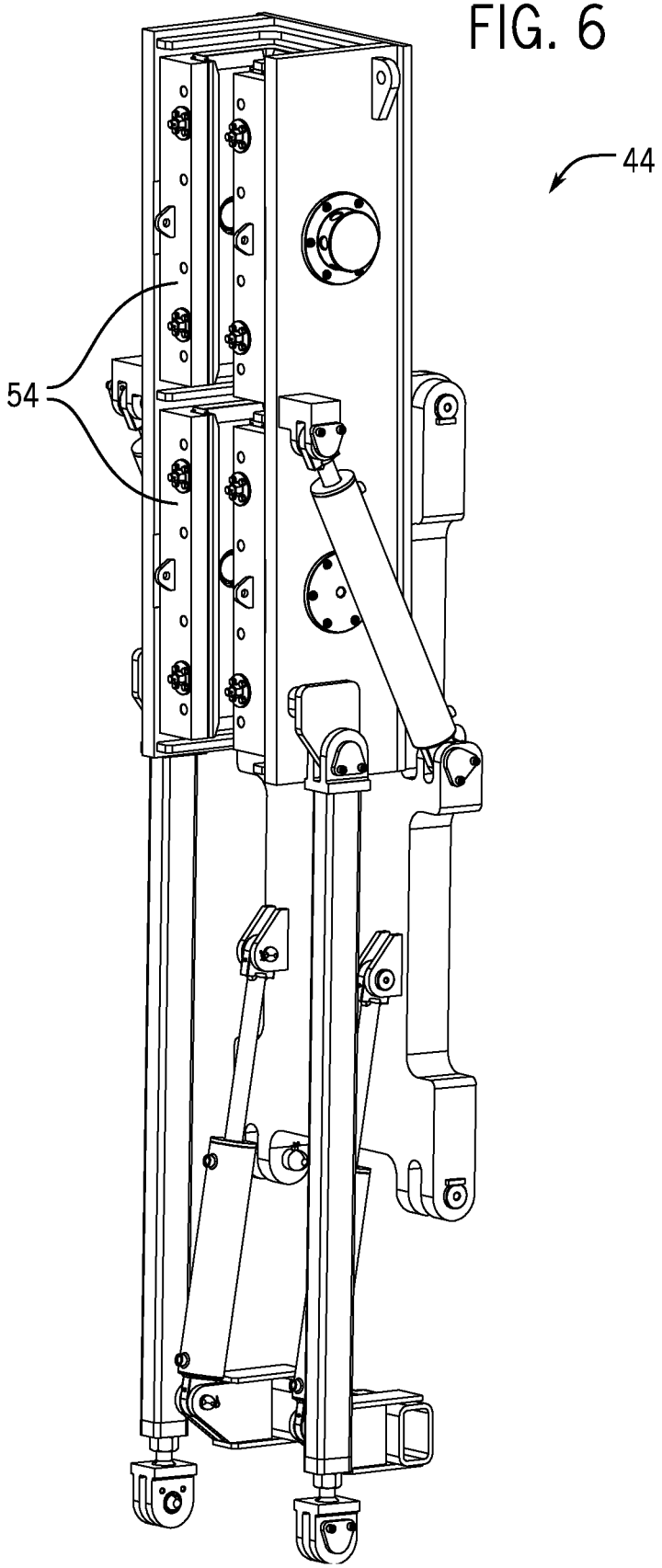
FIG. 6 is a perspective view of a bogey style torque bushing system, in accordance with present techniques.
Figure 7:
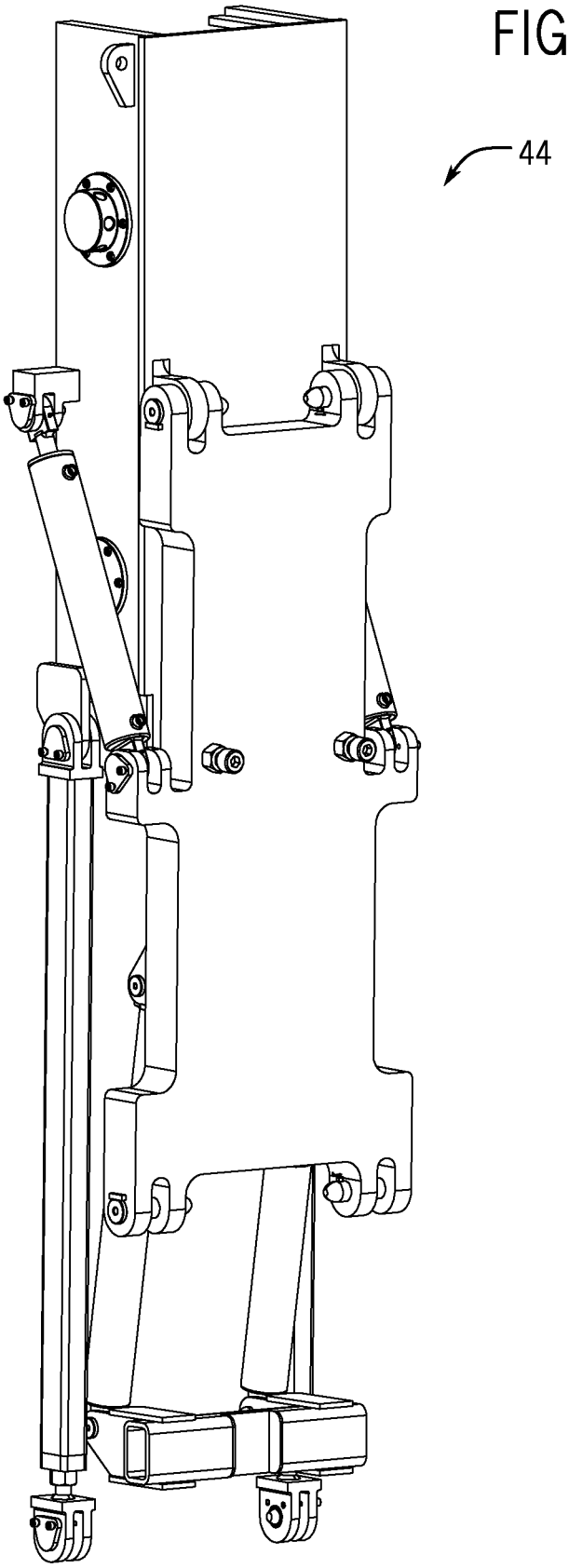
FIG. 7 is a perspective view of a bogey style torque bushing system, in accordance with present techniques.
Figure 8:
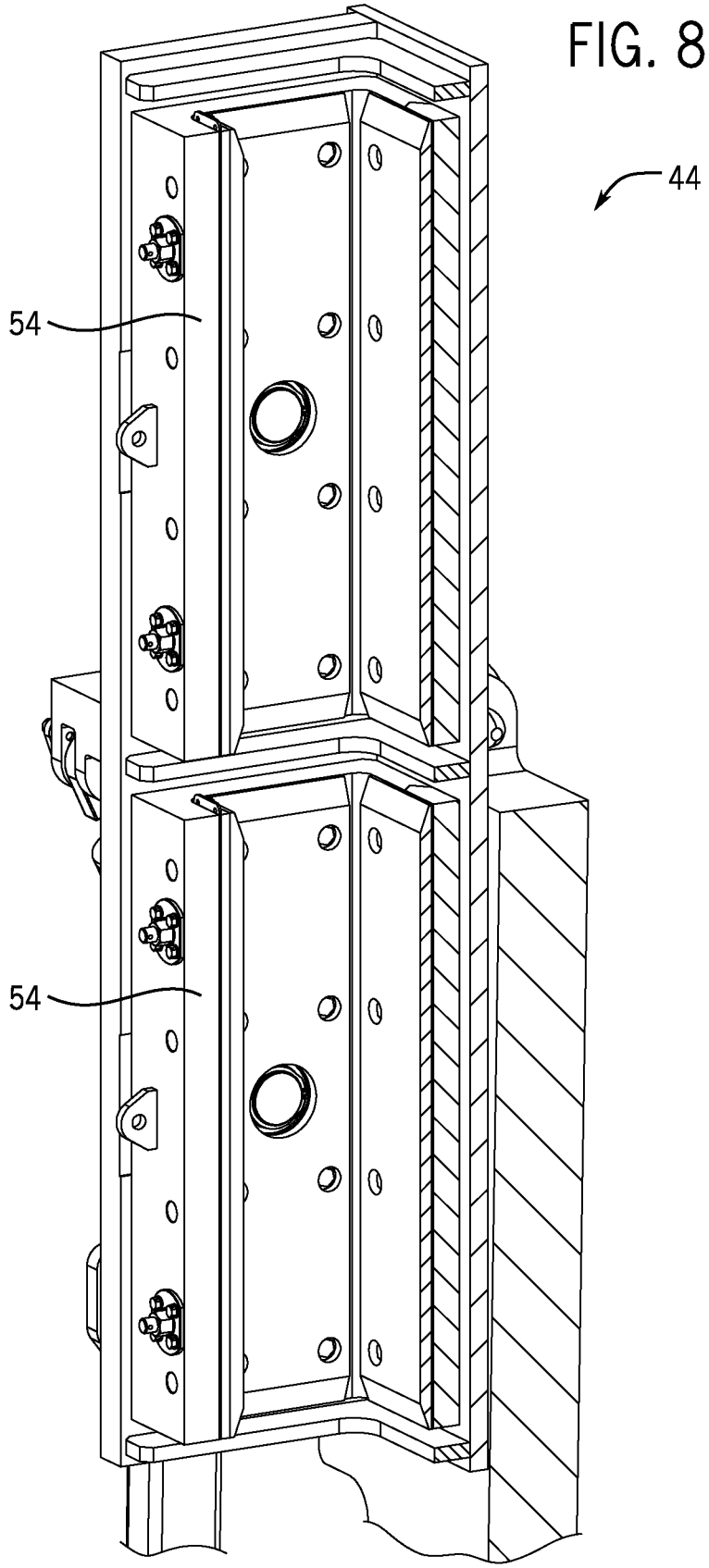
FIG. 8 is a partial perspective view of a bogey style torque bushing system, in accordance with present techniques.
Figure 9:
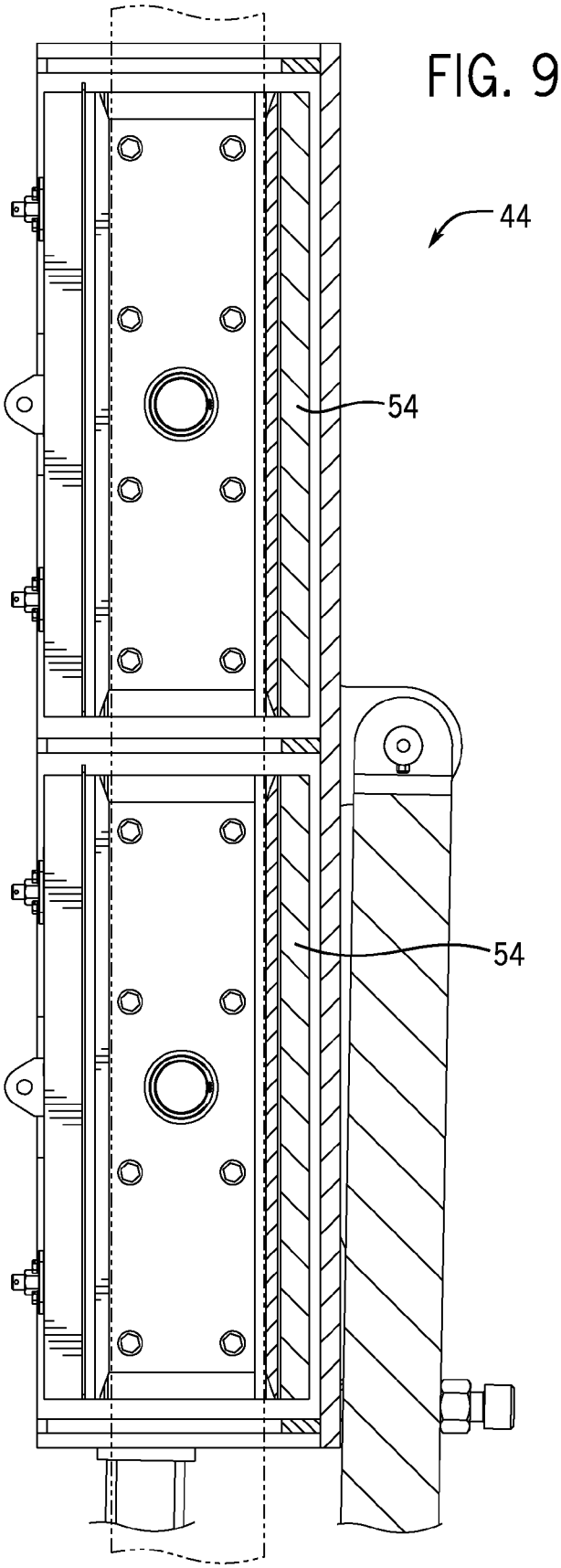
FIG. 9 is a partial side view of a bogey style torque bushing system, in accordance with present techniques.
Figure 10:
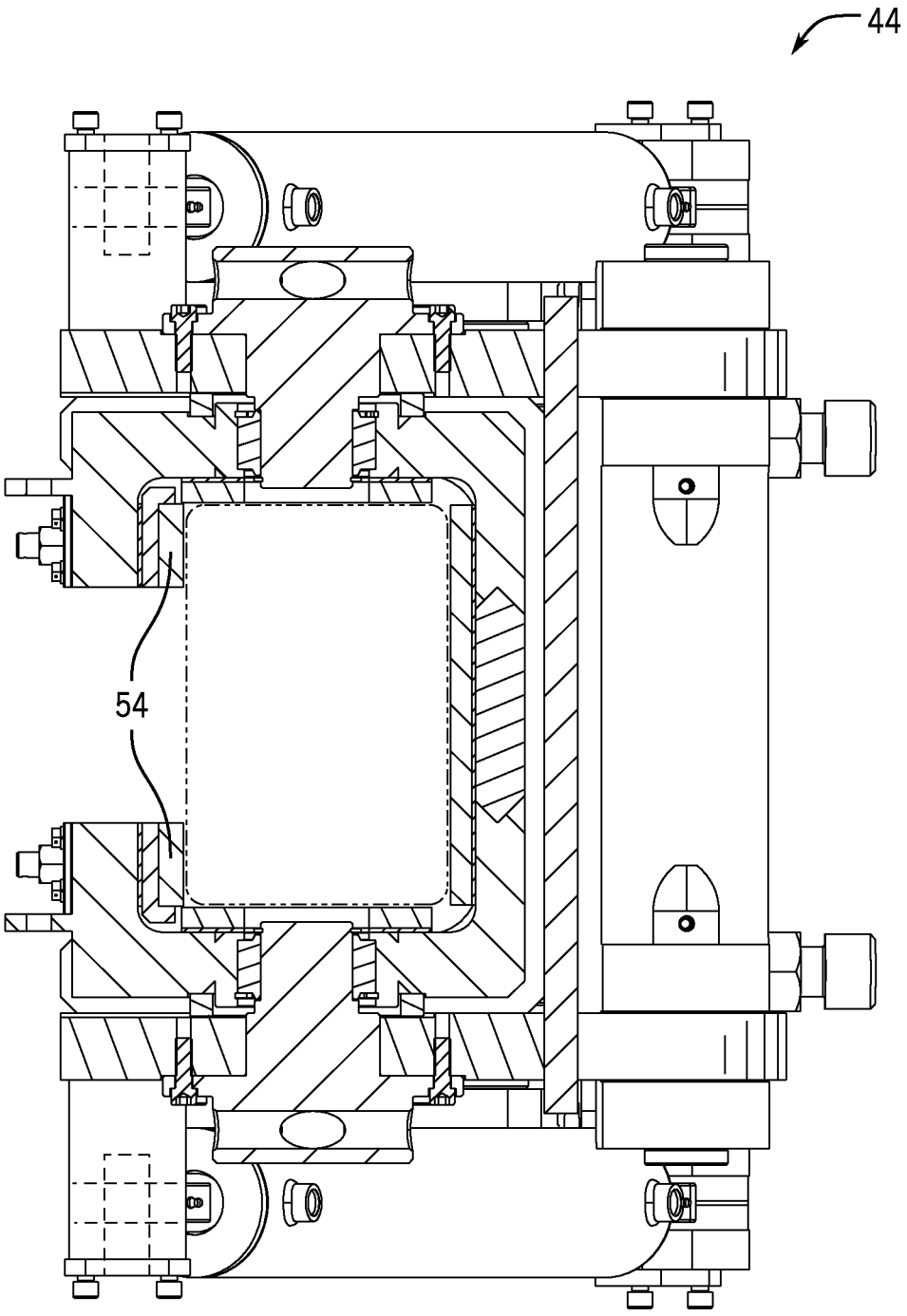
FIG. 10 is a top sectional view of a bogey style torque bushing system, in accordance with present techniques.
Figure 11:
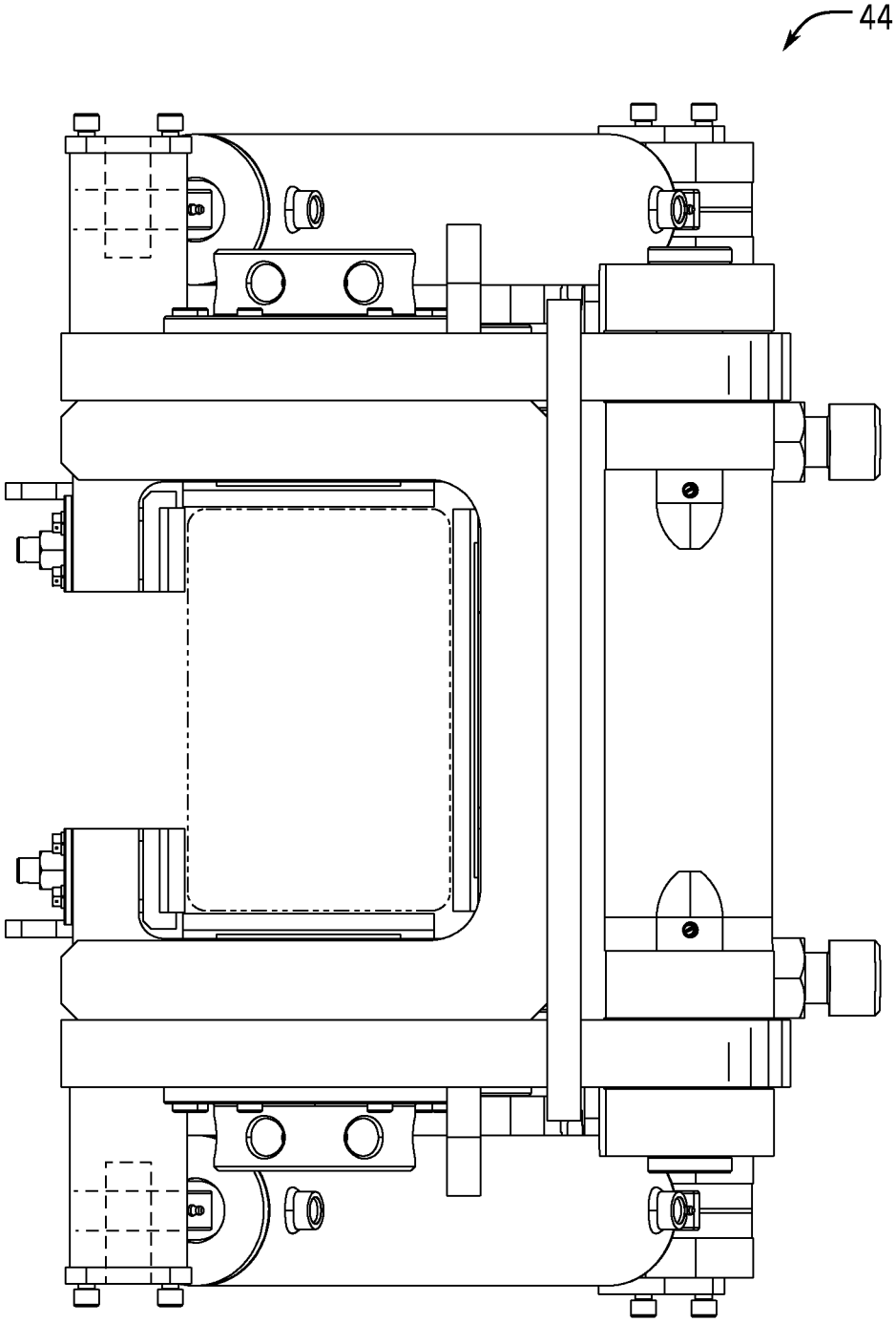
FIG. 11 is a top view of a bogey style torque bushing system, in accordance with present techniques.

FIGS. 6-11 illustrate various views of embodiments of the bogey style torque bushing system 44. For example, FIG. 6 is a perspective view of an embodiment of the bogey style torque bushing system 44, illustrating the bushings 54 configured to couple to the torque track 46. FIG. 7 is another perspective view of an embodiment of the bogey style torque bushing system. FIG. 8 is a partial perspective view of an embodiment of the bogey style torque bushing system 44, illustrating a portion of the bushings 54. FIG. 9 is a partial side view of an embodiment of the bogey style torque bushing system 44, partially illustrating the bushings 54 configured to couple to the torque track 46. FIG. 10 is a top sectional view of an embodiment of the bogey style torque bushing system 44, and FIG. 11 is a top view of an embodiment of the bogey style torque bushing system 44.

Figure 13:
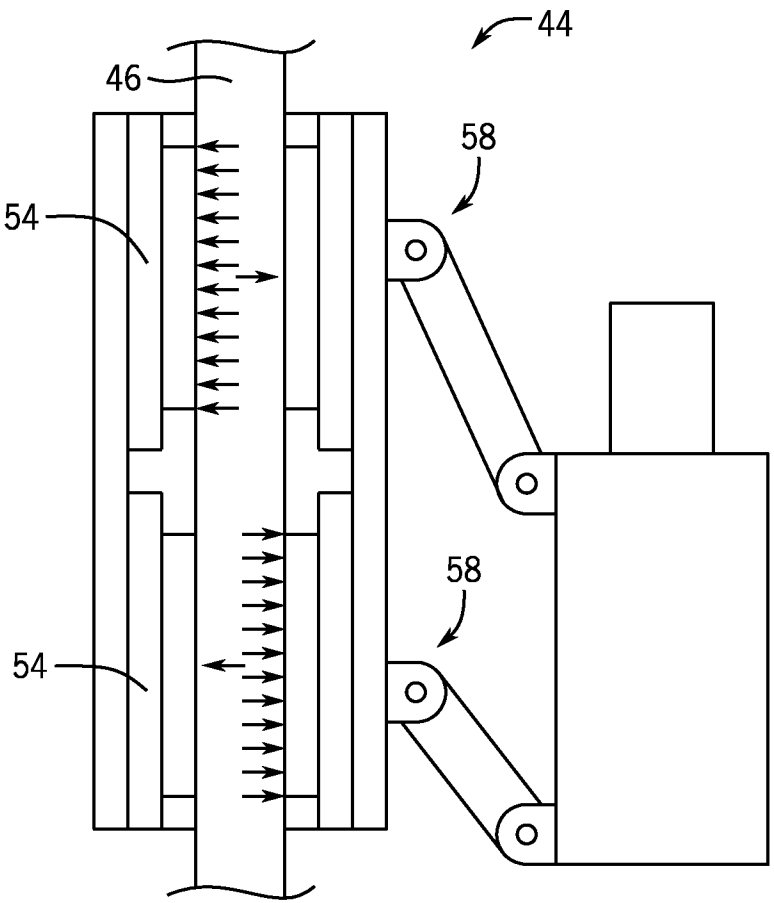
FIG. 13 is a schematic of a bogey style torque bushing system, illustrating forces acting on the bogey style torque bushing system, in accordance with present techniques.
Figure 12:
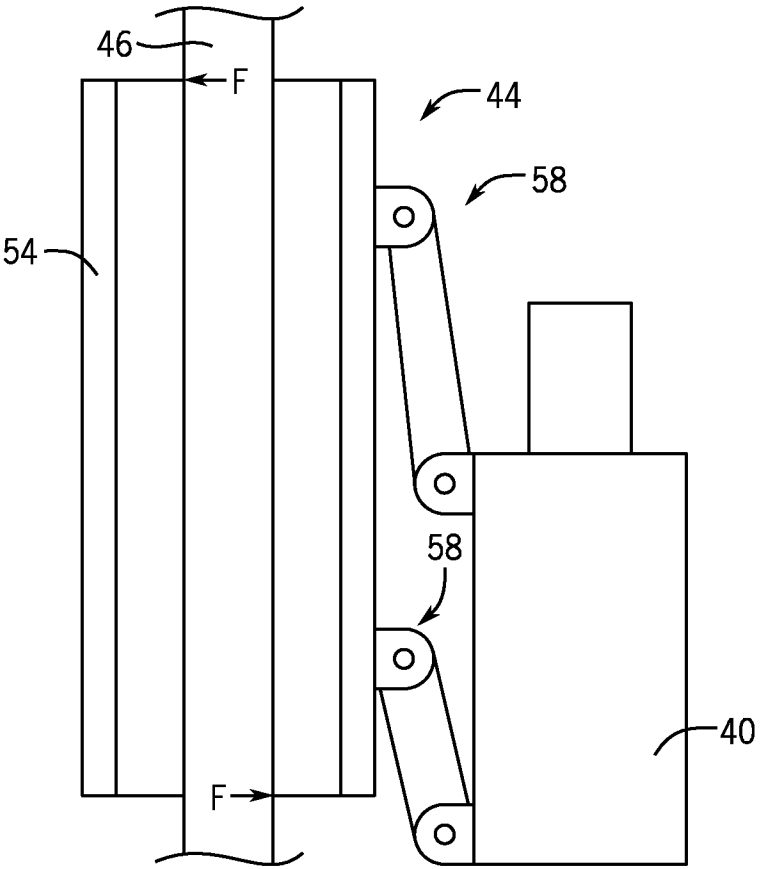
FIG. 12 is a schematic of a bogey style torque bushing system, illustrating forces acting on the bogey style torque bushing system, in accordance with present techniques.

FIGS. 12 and 13 are schematics of embodiments of the bogey style torque bushing system 44, illustrating forces acting on the bogey style torque bushing system 44. As shown in FIG. 12, the bogey style torque bushing system 44 has one bushing 54. On the one bushing 54, the overturning moment acting on the top drive 40 causes a reactionary coupling primarily near ends of the bushing 54. These high forces on small areas of the bushing 54 cause high pressure. The wear on the wear or liner material of the bushing 54 is proportional to pressure times velocity. In FIG. 13, the bogey style torque bushing system 44 includes two bushings 54. As such, the coupling force acting on the pinned connections 58 at the middle of each bushing 54 causes the reaction forces to be distributed evenly along the surface of the wear or liner material of the bushings 54, thereby resulting in a lower pressure acting on the various points of the bushings 54.

As discussed in detail above, embodiments of the present disclosure are directed towards the bogey style torque bushing system 44. In the manner described above, the bogey style torque bushing system 44 is configured to absorb reaction forces caused by the overturning moment 50 acting on the top drive 40. In certain embodiments, the overturning moment 50 is created when the center of gravity of the top drive 40 is not aligned with the hanging load of the top drive 40. The bogey style torque bushing system 44 may couple the top drive 40 to the torque track 46 of the derrick 14 or to other surface equipment. In certain embodiments, the bogey style torque bushing system 44 includes the bogey chassis 52 which couples to the top drive 40. The bogey chassis 52 further couples to two or more bushings 54, which are connected to the torque track 46. As discussed in detail above, overturning moment 50 reaction forces created by the top drive 40 may be applied at respective centers (e.g., axial midpoints) of the bushings 54. Specifically, the bushings 54 may be configured to transfer a distributed direct normal force to the torque track 46. In this manner, forces caused by the overturning moment 50 and acting on other components of the top drive 40 may be absorbed, while reducing premature and excessive wear on torque bushing components.

While the present disclosure may be susceptible to various modifications and alternative forms, specific embodiments have been shown by way of example in the drawings and tables and have been described in detail herein. However, it should be understood that the embodiments are not intended to be limited to the particular forms disclosed. Rather, the disclosure is to cover all modifications, equivalents, and alternatives falling within the spirit and scope of the disclosure as defined by the following appended claims. Further, although individual embodiments are discussed herein, the disclosure is intended to cover all combinations of these embodiments.

The invention claimed is:

1. A top drive system, comprising:

a top drive;

a bogey chassis, wherein the top drive is coupled the bogey chassis;

an upper bushing coupling the bogey chassis to a torque track; and a lower bushing coupling the bogey chassis to the torque track, wherein the upper and lower bushings are configured to translate along the torque track, and wherein a first vertical distance between the top drive and the upper bushing is greater than a second vertical distance between the top drive and the lower bushing.

2. The system of claim 1, wherein the bogey chassis is coupled to the upper bushing by a first pin at approximately an axial midpoint of the upper bushing.

3. The system of claim 2, wherein bogey chassis is coupled to the lower bushing by a second pin at approximately an axial midpoint of the lower bushing.

4. The system of claim 2, wherein the bogey chassis comprises an adjustment mechanism comprising an adjustment pin threadably coupled to the bogey chassis and configured to engage with the first pin.

5. The system of claim 4, wherein rotation of the adjustment pin adjusts the vertical orientation of a central member of the bogey chassis relative to the torque track, wherein the central member of the bogey chassis is fixed to the top drive.

6. The system of claim 1, wherein the top drive is coupled to the bogey chassis by a plurality of pivoting arms, wherein the plurality of pivoting arms is configured to rotate and laterally extend the top drive from the torque track.

7. The system of claim 6, wherein rotation of the plurality of pivoting arms is actuated by a plurality of hydraulic cylinders.

8. The system of claim 1, wherein each of the upper bushing and lower bushing comprises a plurality of rollers configured to reduce friction between the upper bushing and the lower bushing and the torque track.

9. The system of claim 1, wherein a single pinned connection couples the top drive, the bogey chassis, and the lower bushing.

10. The system of claim 1, comprising a center of gravity of the top drive, wherein the center of gravity is offset from an axis of a hanging load of the top drive.

11. A system, comprising:

a torque bushing system configured to be coupled to a top drive comprising a first bushing and a second bushing; and a torque track system, wherein the torque bushing system is configured to absorb an overturning moment acting on the top drive and apply resulting linear forces to the torque track system, wherein the torque bushing system comprises a leveling system configured to adjust the levelness of the top drive, and wherein the leveling system comprises an adjustable pin and rotating of the adjustable pin adjusts the vertical orientation of a central member of a bogey chassis coupled to the top drive.

12. The system of claim 11, wherein the overturning moment is generated by a center of gravity of the top drive that is offset from an axis of a hanging load of the top drive.

13. The system of claim 11, wherein the torque bushing system comprises the bogey chassis coupled to the top drive, an upper bushing coupling the bogey chassis to the torque track, and a lower bushing coupling the bogey chassis to the torque track.

14. The system of claim 13, wherein the top drive is fixed to the bogey chassis with a plurality of pins.

15. The system of claim 13, wherein the upper bushing is coupled to the bogey chassis by a first pin at an approximate axial midpoint of the upper bushing, and the lower bushing is coupled to the bogey chassis by a second pin at an approximate axial midpoint of the lower bushing.

16. A top drive system, comprising:

a top drive;

a bogey chassis, wherein the top drive is coupled the bogey chassis;

an upper bushing coupling the bogey chassis to a torque track; and a lower bushing coupling the bogey chassis to the torque track, wherein the upper and lower bushings are configured to translate along the torque track, wherein the top drive is coupled to the bogey chassis by a plurality of pivoting arms, wherein the plurality of pivoting arms is configured to rotate and laterally extend the top drive from the torque track, wherein rotation of the plurality of pivoting arms is actuated by a plurality of hydraulic cylinders, and wherein a first vertical distance between the top drive and the upper bushing is greater than a second vertical distance between the top drive and the lower bushing.

17. The system of claim 16, wherein the bogey chassis is coupled to the upper bushing by a first pin at approximately an axial midpoint of the upper bushing.

18. The system of claim 17, wherein bogey chassis is coupled to the lower bushing by a second pin at approximately an axial midpoint of the lower bushing.

19. The system of claim 16, wherein each of the upper bushing and lower bushing comprises a plurality of rollers configured to reduce friction between the upper bushing and the lower bushing and the torque track.

20. A top drive system, comprising:

a top drive;

a bogey chassis, wherein the top drive is coupled the bogey chassis;

an upper bushing coupling the bogey chassis to a torque track; and a lower bushing coupling the bogey chassis to the torque track, wherein the upper and lower bushings are configured to translate along the torque track, wherein each of the upper bushing and lower bushing comprises a plurality of rollers configured to reduce friction between the upper bushing and the lower bushing and the torque track, wherein the upper bushing comprises an adjustable pin and rotating of the adjustable pin adjusts a vertical orientation of a central member of the bogey chassis coupled to the top drive.

21. A top drive system, comprising:

a top drive;

a bogey chassis, wherein the top drive is coupled the bogey chassis;

an upper bushing coupling the bogey chassis to a torque track; and a lower bushing coupling the bogey chassis to the torque track, wherein the upper and lower bushings are configured to translate along the torque track, and, wherein the torque bushing system comprises a leveling system configured to adjust the levelness of the top drive, and the leveling system comprises an adjustable pin and rotating of the adjustable pin adjusts the vertical orientation of a central member of the bogey chassis coupled to the top drive.

* * * * *